US009993120B2

(12) United States Patent
Xie

(10) Patent No.: US 9,993,120 B2
(45) Date of Patent: Jun. 12, 2018

(54) LIQUID SOAP DISPENSER WITH CONTROLS POSITIVE AND REVERSE ROTATIONS OF MOTOR AND LIQUID DISCHARGE AMOUNT THROUGH ANGLE COUNTING

(71) Applicant: Huoxian Xie, Guangdong (CN)

(72) Inventor: Huoxian Xie, Guangdong (CN)

(73) Assignee: Shenzhen Smarlean Hygiene Co., Ltd, Shenzhen, Guangdong (CN)

( * ) Notice: Subject to any disclaimer, the term of this patent is extended or adjusted under 35 U.S.C. 154(b) by 16 days.

(21) Appl. No.: 15/323,109

(22) PCT Filed: Aug. 8, 2014

(86) PCT No.: PCT/CN2014/083943
§ 371 (c)(1),
(2) Date: Dec. 30, 2016

(87) PCT Pub. No.: WO2016/000294
PCT Pub. Date: Jan. 7, 2016

(65) Prior Publication Data

US 2017/0156549 A1 Jun. 8, 2017

(30) Foreign Application Priority Data

Jun. 30, 2014 (CN) ..... 2014 1 0305858

(51) Int. Cl.

| | |
|---|---|
| ***B67D 7/14*** | (2010.01) |
| ***B05B 7/00*** | (2006.01) |
| ***A47K 5/12*** | (2006.01) |
| ***F04B 19/22*** | (2006.01) |
| ***F04B 9/02*** | (2006.01) |
| ***F04B 49/06*** | (2006.01) |

(52) U.S. Cl.
CPC ..... *A47K 5/1217* (2013.01); *A47K 5/1211* (2013.01); *F04B 9/02* (2013.01); *F04B 19/22* (2013.01); *F04B 49/06* (2013.01)

(58) Field of Classification Search
CPC ..... F04B 9/02; F04B 9/22
USPC ..... 222/30, 52, 63, 258, 333, 626, 630
See application file for complete search history.

(56) References Cited

U.S. PATENT DOCUMENTS 2,928,573 A * 3/1960 Edelstein ..... A61L 9/14 222/394
5,836,482 A * 11/1998 Ophardt ..... A47K 5/1202 222/181.1
6,568,561 B2 * 5/2003 Studer ..... A47K 5/1209 222/214

(Continued)

*Primary Examiner* — Vishal Pancholi

(57) ABSTRACT

A liquid soap dispenser, which controls positive and reverse rotations of a motor and a liquid discharge amount through angle counting, includes a front cover, a back cover, a liquid soap bottle, a pump component, a main engine and a key. An angle counter is arranged in the main engine. The liquid soap dispenser is connected with the motor. The angle counter is driven to rotate through the motor, so as to measure a rotation angle of the motor. The motor is connected with a gearbox, and the gearbox is connected with an output gear. The output gear is fastened at a lower part of the pump component, and the pump component is driven to move through the output gear. The liquid soap dispenser realizes a stepless adjustment of the liquid discharge amount through controlling the motor to reversely rotate.

9 Claims, 4 Drawing Sheets

(56) References Cited

U.S. PATENT DOCUMENTS

| | | | | |
|---|---|---|---|---|
| 8,905,265 | B2 * | 12/2014 | Muderlak | A47K 5/1207 222/181.3 |
| 2003/0006246 | A1 * | 1/2003 | Studer | A47K 5/1209 222/52 |
| 2004/0050876 | A1 * | 3/2004 | Muderlak | A47K 5/1217 222/333 |
| 2006/0124662 | A1 * | 6/2006 | Reynolds | A47K 5/1217 222/23 |
| 2012/0111895 | A1 * | 5/2012 | Fitzpatrick | A47K 5/1209 222/214 |

* cited by examiner

LIQUID SOAP DISPENSER WITH CONTROLS POSITIVE AND REVERSE ROTATIONS OF MOTOR AND LIQUID DISCHARGE AMOUNT THROUGH ANGLE COUNTING

CROSS REFERENCE OF RELATED APPLICATION

This is a U.S. National Stage under 35 U.S.C 371 of the International Application PCT/CN2014/083943, filed Aug. 8, 2014, which claims priority under 35 U.S.C. 119(a-d) to CN 201410305858.9, filed Jun. 30, 2014.

BACKGROUND OF THE PRESENT INVENTION

Field of Invention

The present invention relates to a soap dispensing device, and more particularly to an automatic soap foam/liquid soap dispenser.

Description of Related Arts

The liquid soap dispenser is a bathroom electric appliance for automatically dispensing the liquid soap when washing hand, so as to avoid the secondary pollution. In a place such as a public restroom, the liquid soap dispenser is generally arranged for squeezing the hand sanitizer out. For the conventional liquid soap dispenser, the liquid soap is squeezed out through a soap bag liquid squeezing device. However, the squeezing soap bag is done manually, which is inconvenient; and a direct contact to the liquid soap dispenser by the hand is insanitary.

The Chinese patent application, CN200320123483.1, is a human body induction liquid soap dispenser, comprising an outer case in which a cavity is provided, wherein: a soap bag liquid squeezing device is connected to the bottom part of the outer case and next to the provided cavity; an infrared sensor and a corresponding control circuit are connected to the bottom part of the outer case; a small motor connected with the control circuit is also connected to the bottom part of the outer case, and the output shaft of the small motor is connected with a reciprocating motion mechanism through a gear reducer; and, the reciprocating motion mechanism along with the soap bag liquid squeezing device forms an infrared sensing liquid discharging device. During use, when the hand is placed close to the infrared sensor, the small motor is triggered to work and automatically squeezes the soap bag liquid squeezing device to discharge the liquid, which is convenient, avoids a direct contact with the dispenser, and greatly increases the degree of cleanness when used in the public place. However, the soap bags have a short service life and are easy to be damaged, and if the control of the liquid discharge amount is inaccurate, a great waste is usually caused.

Later, people designed the cylinder-type liquid squeezing device. The output gear is driven by the motor, and then the liquid squeezing device is driven to discharge the liquid, and the liquid discharge amount is accurately controlled and the service life of the dispensers has increased a lot. The dispensers having such an operation principle can be classified into two categories by angle. In the case of the first category, the output gear of the gearbox rotates 180 degrees to complete the pumping action, then rotates another 180 degrees to realize the sucking process of the pump body. The advantages are that the motor does not change directions, the speed of the output gear is fast, and the gear ratio is low, while the disadvantages are that the working current is high, and the liquid discharge amount cannot be automatically adjusted. In the case of the second category, the output gear of the gearbox rotates by an acute angle to accomplish the pumping action, and then reversely rotates by the acute angle to realize the sucking action of the pump body. The difference is that the motor reverses. However, the currents, generated at an initial point and an end point of the acute angle, are high lock rotor motor currents, and only when the control circuit senses the high surging current, the motor is controlled to reversely rotate, causing the slow speed of the output gear and the high gear ratio. The disadvantages are that the high lock rotor motor currents are generated, and the discharge liquid amount cannot be adjusted.

SUMMARY OF THE PRESENT INVENTION

An object of the present invention is to provide a liquid soap dispenser which controls positive and reverse rotations of a motor and a liquid discharge amount through angle counting. Though controlling the motor to rotate reversely, the liquid soap dispenser realizes a stepless adjustment of the liquid discharge amount and achieves an adjustment function of the liquid discharge amount. When the motor reversely rotates, high lock rotor motor currents at an initial point and an end point are avoided, and a service life of a battery and parts is increased. Moreover, the present invention has a small current and a simple structure.

Another object of the present invention is to provide a liquid soap dispenser which controls the positive and reverse rotations of the motor and the liquid discharge amount through angle counting. The liquid soap dispenser is easy to be realized, has a low cost, is able to guarantee a pressure lever to be back to an original point, has no leakage, and saves liquid soap.

Accordingly, in order to accomplish the above objects, the present invention adopts following technical solutions.

A liquid soap dispenser, which controls positive and reverse rotations of a motor and a liquid discharge amount through angle counting, comprises: a front cover, a back cover, a liquid soap bottle, a pump component, a main engine and a key, wherein: the liquid soap dispenser further comprises an angle counter; the liquid soap dispenser is connected with the motor; the angle counter is driven to rotate through the motor, so as to measure a chosen angle; the motor is connected with a gearbox, and the gearbox is connected with an output gear; the output gear is fastened at a lower part of the pump component; and the pump component is driven to move through the output gear.

A circuit board has a control circuit and a control integrated circuit (IC), and the control IC controls a rotation of the motor through a program, which belongs to the prior art. The pump component also belongs to the prior art and is similar as a pump sliding block illustrated in Chinese patent application, CN201320284070.5, Device for fixing oil seal of emulsion pump component. Thus, the circuit board and the pump component are not described in detail.

The angle counter and the motor are coaxially arranged, so that the angle counter is able to accurately measure a rotation angle of the motor.

The angle counter comprises an angle counting gear, a photosensitive element and a support board, wherein: an edge of the angle counting gear has multiple light transmitting slits; the photosensitive element is arranged at a periphery of the angle counting gear and judges an angle chosen by the angle counting gear through sensing lights transmitted through the light transmitting slits; and, the support board is for supporting and fixing the angle counting gear and the photosensitive element. After energizing the motor, the angle counting gear starts to rotate; and meanwhile, the photosensitive element senses the light through the light transmitting slits of the angle counting gear, starts to count, and transmits a counting value to the control circuit, so as to control a start and a stop of the motor.

The light transmitting slits are uniformly arranged at the edge of the angle counting gear according to a certain angle.

The support board is a printed circuit board (PCB), not only able to support the photosensitive element but also electrically connected with the photosensitive element and the control circuit for more compactly and more stably arranging each part.

The light transmitting slits are triangular, square, trapezoidal, circular or elliptic.

The output gear has a shaft, and a convex reciprocating motion mechanism is fixed on the shaft along a radial direction of the shaft. The reciprocating motion mechanism is fastened at the lower part of the pump component, for controlling a liquid pumping and sucking action of the pump component.

The reciprocating motion mechanism is two occlusion teeth which extend outward along the radial direction of the shaft of the output gear; and an appropriate slot is provided between the occlusion teeth, for allowing the lower part of the pump component to pass through. The occlusion teeth are both stuck on a convex part at the lower part of the pump component, so as to drive the pump component to move back and forth.

The gearbox comprises a power gear and a transmission gear, wherein: the power gear is sleeved on a shaft of the motor and meshes with the transmission gear; and the transmission gear meshes with the output gear for controlling the pump component.

The gearbox further comprises a protection shell for separating the power gear from the motor, so that a mutual interference between the power gear and the motor is avoided. The power gear and the transmission gear are arranged on the protection shell, and the protection shell is able to effectively protect the power gear, the transmission gear and the output gear from an external damage at the same time.

A liquid pumping process has following steps. After energizing, the motor starts to rotate; a power is transmitted to the output gear through the gearbox; and a rotation of the output gear drives the pump component to move from bottom to top, which realizes a liquid pumping action.

A liquid sucking process of a pump body has following steps. After liquid pumping is finished, the motor starts to reversely rotate; the power is transmitted to the output gear through the gearbox; the rotation of the output gear drives the pump component to move from top to bottom, which realizes a liquid sucking action of the pump body.

During liquid pumping, it is feasible to change a preset angle value of the motor through adjusting a control signal of the control circuit, so that a swinging angle of the output gear is changed and a stepless adjustment of the liquid discharge amount is realized.

Compared with the prior art, the present invention inducts the rotation angle of the motor through the angle counter, and then, according to a rotation condition of the motor, controls the motor to reversely rotate and controls the rotation angle, so as to realize the stepless adjustment of the liquid discharge amount and achieve the adjustment function of the liquid discharge amount. When the motor rotates reversely, the high lock rotor motor currents at the initial point and the end point are avoided, and the service life of the battery and the parts is increased. Moreover, the present invention has a simple structure and is easy to be realized.

DETAILED DESCRIPTION OF THE PREFERRED EMBODIMENT

In order to more clearly illustrate objects, technical solutions and advantages of the present invention, the present invention is further described in detail with accompanying drawings and a preferred embodiment. The described preferred embodiment is exemplary only and not intended to be limiting.

Figure 1:
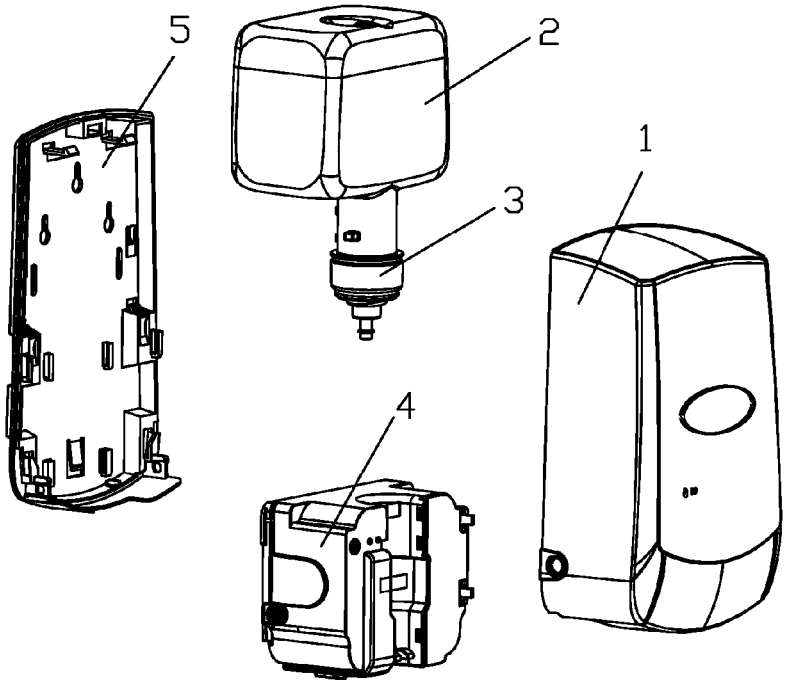
FIG. 1 is an exploded view of a liquid soap dispenser according to a preferred embodiment of the present invention.

According to a preferred embodiment of the present invention, as showed in FIG. 1, a liquid soap dispenser comprises: a front cover 1, a liquid soap bottle 2, a pump component 3, a main engine 4 and a back cover 5, wherein: the front cover 1 and the back cover 5 form a body case which is substantially sealed; and, the liquid soap bottle 2, the pump component 3 and the main engine 4 are sealed in the body case, not only for protection but also for a beautiful and simple appearance.

Figure 2:
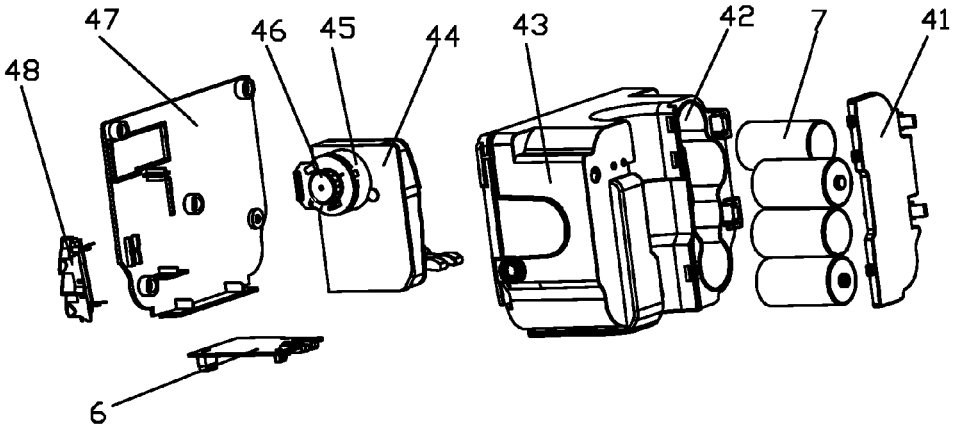
FIG. 2 is an exploded view of a main engine according to the preferred embodiment of the present invention.

The liquid soap bottle 2, the pump component 3, and the main engine 4 are the core parts of the liquid soap dispenser. The liquid soap bottle 2 and the pump component 3 have a common structure and thus not described in detail. As showed in FIG. 2, the main engine 4 comprises: a battery cover 41, a battery holder 42, a main engine front cover 43, a gearbox 44, a main engine back cover 47, a mainboard 6 and an induction lamp component 48, wherein: four C batteries 7 are generally arranged in the battery holder 42, so as to provide a power for the liquid soap dispenser; the battery holder 42 is arranged in the main engine front cover 43 and covered by the battery cover 41; the induction lamp component 48 generally consists of a plurality of induction lamps, and an error caused by a single induction lamp is reduced through inducting with the plurality of induction lamps.

A motor 45 and an angle counter 46 are arranged on a back surface of the gearbox 44.

The mainboard 6, with a control circuit and an integrated circuit (IC), is able to intelligently control the motor 45. The control circuit of the mainboard 6 is electrically connected with the motor 45 and the angle counter 46. The mainboard 6 controls positive and reverse rotations of the motor 45 through the control circuit; and, the angle counter 46 records a rotation angle of the motor 45 and feeds back a result thereof to the control circuit, so as to control the rotation angle of the motor 45 through the control circuit and realize a stepless adjustment of a liquid discharge amount.

The main engine front cover 43 and the main engine back cover 47 are for fixing the gearbox 44 and the mainboard 6 inside, so as to achieve a more compact and more stable structure.

Figure 3:
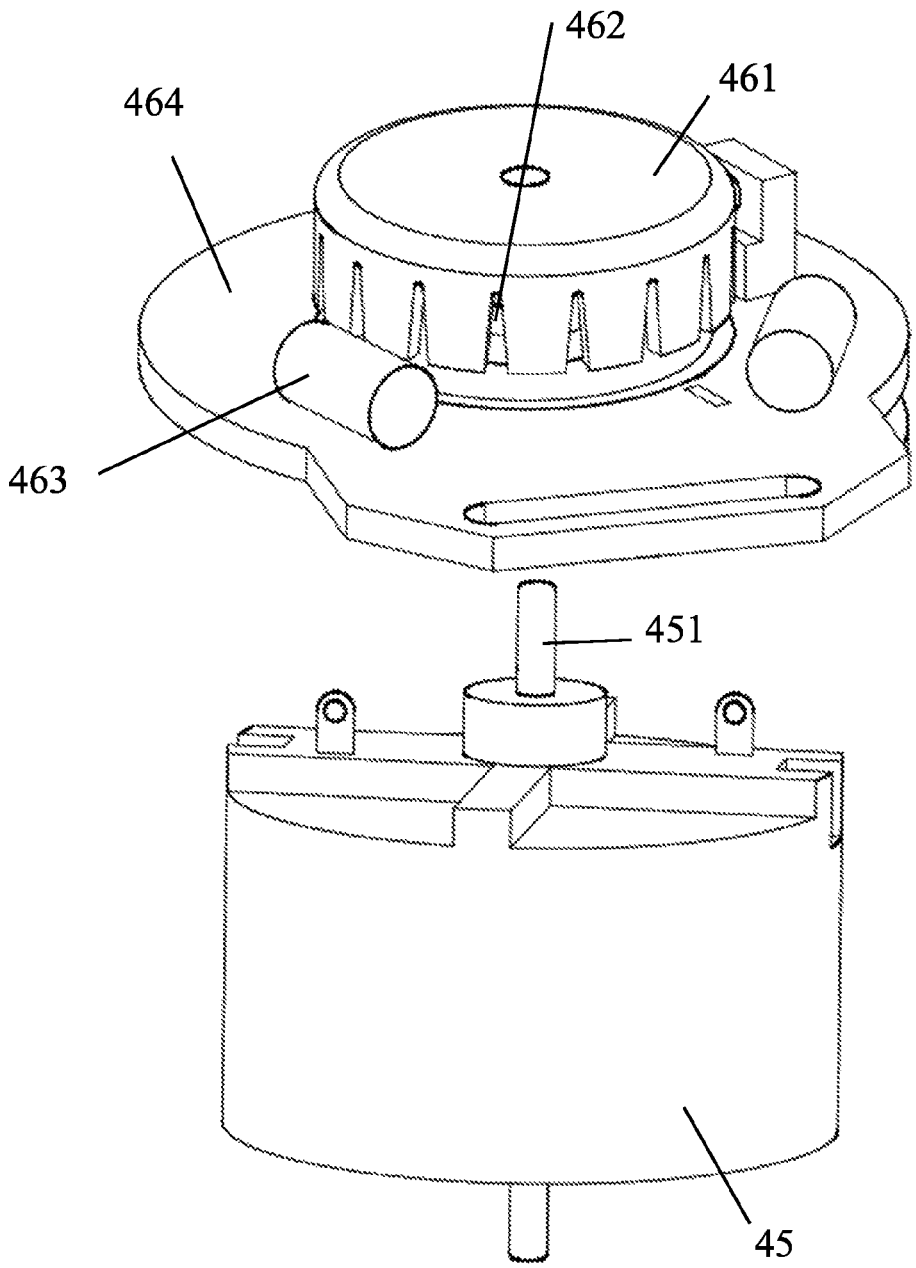
FIG. 3 is a structural sketch view of a motor and an angle counter according to the preferred embodiment of the present invention.
Figure 4:
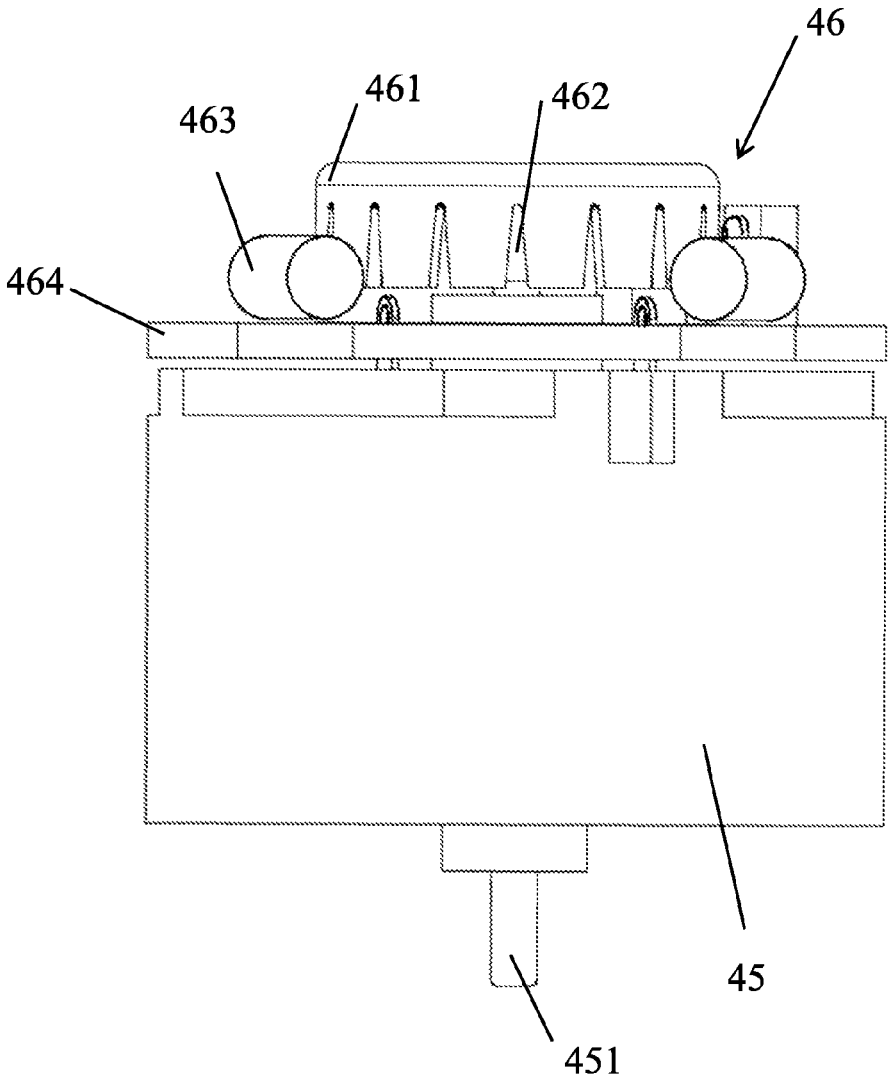
FIG. 4 is a front view of the motor and the angle counter according to the preferred embodiment of the present invention.

Referring to FIG. 3 and FIG. 4, two important functional parts of the present invention are the angle counter 46 and the motor 45. As showed in FIG. 3 and FIG. 4, the angle counter 46 and the motor 45 are generally coaxially arranged, namely a shaft 451 of the motor 45 drives the angle counter 46 to rotate, in such a manner that not only less parts are required to be arranged but also a rotation synchronization between the angle counter 46 and the motor 45 is effectively guaranteed, so that the angle counter 46 has an accurate and reliable measurement result of the motor 45.

The angle counter 46 comprises an angle counting gear 461, photosensitive elements 463 and a support board 464. The angle counting gear 461 is supported by the shaft 451 of the motor 45 and is discoid; and an edge of the angle counting gear 461 has multiple light transmitting slits 462. The number of the photosensitive elements 463 is more than one (generally 2-4); the photosensitive elements 463 are respectively arranged at a peripheral of the angle counting gear 461, and able to judge an angle chosen by the angle counting gear 461 through sensing lights transmitted through the light transmitting slits 462 and feed back a result thereof to the mainboard 6. The support board 464 is arranged below the angle counting gear 461 and the photosensitive elements 463, for fixing and supporting the angle counting gear 461 and the photosensitive elements 463; the support board 464 is generally a printed circuit board (PCB) of the angle counter 46, and the angle counter 46 is electrically connected with the support board 464. After energizing the motor, the angle counting gear starts to rotate; and meanwhile, the photosensitive elements sense the lights through the light transmitting slits of the angle counting gear, start to count, and send a counting value to the control circuit, so as to control a start and a stop of the motor.

The light transmitting slits 462 are uniformly provided at the edge of the angle counting gear according to a certain angle (generally with an interval of 5°).

The light transmitting slits 462 are feasible to be triangular, square, trapezoidal, circular and elliptic. According to requirements, a specific shape of the light transmitting slits is also feasible. According to the preferred embodiment of the present invention, the light transmitting slits are triangular.

Figure 5:
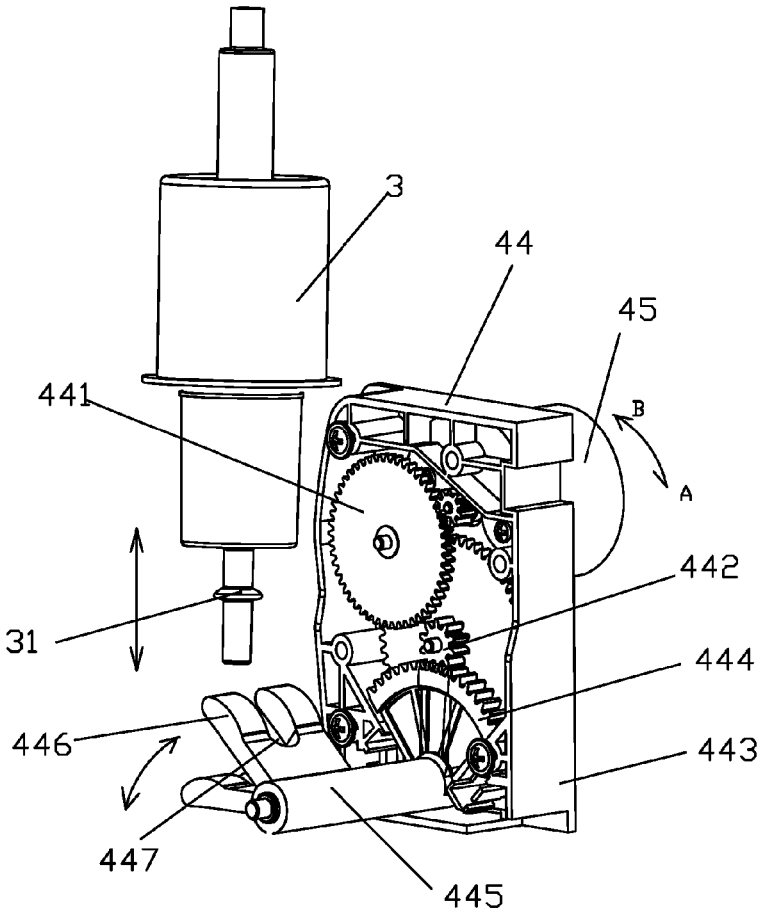
FIG. 5 is a structural sketch view of a gearbox and a pump component according to the preferred embodiment of the present invention.

Referring to FIG. 5, an output gear 444 is adopted to control the pump component 3, wherein: the output gear 444 meshes with a transmission gear 442; the output gear 444 has an output shaft 445 located at a middle of the output gear 444; two occlusion teeth 446 extend outward along a radial direction of the output shaft 445; an occlusion slot 447 is provided between the two occlusion teeth 446, for allowing a lower part of the pump component 3 to pass through; and, both of the occlusion teeth 446 are stuck on a circular convex part 31 at the lower part of the pump component 3, so as to drive the pump component to move back and forth.

Furthermore, the two occlusion teeth 446 form a forked structure, so as to stably fasten the circular convex part 31; and meanwhile, upper surfaces of the two occlusion teeth 446 are cambered, so as to protect the pump component 3 from damage.

Furthermore, an interior of the occlusion slot 447 is arc and has a distance larger than a direct distance between the two occlusion teeth 446, so that the two occlusion teeth 446 stably fasten the circular convex part 31 and a separation condition is avoided.

The gearbox 44 has a similar structure as a conventional gearbox, comprising: a power gear 441, and the transmission gear 442, wherein: the power gear 441 is sleeved on the shaft 451 of the motor 45 and meshes with the transmission 442; and the transmission gear 442 meshes with the output gear 444, so as to control the pump component 3.

A protection shell 443 is arranged outside the gearbox and separates the power gear 441 from the motor 45, so as to avoid a mutual interference between the power gear and the motor; meanwhile, the power gear 441, the transmission gear 442 and the output gear 444 are all arranged on the protection shell 443, and the protection shell 443 is able to effectively protect the power gear 441, the transmission gear 442 and the output gear 444 from an external damage at the same time.

Figure 6:
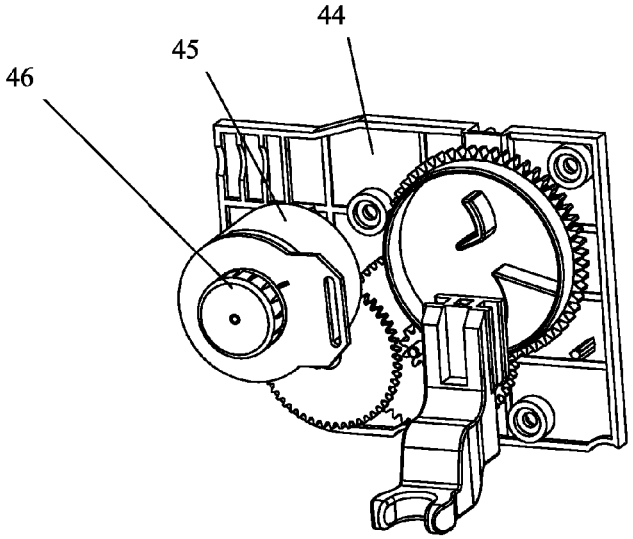
FIG. 6 is another structural sketch view of the gearbox according to the preferred embodiment of the present invention.

Alternatively, it is feasible to arrange the power gear 441 and the motor 45 at one side, as showed in FIG. 6.

When pumping a liquid: after energizing, the motor 45 starts to rotate; a power is transmitted to the output gear 444 through the gearbox 44; and a rotation of the output gear 444 enables the occlusion teeth 446 on the output shaft 445 to drive the pump component 3 to move from bottom to top, so as to realize a liquid pumping action.

When sucking the liquid: after finishing pumping the liquid, under a control of the control circuit, the motor 45 starts to reversely rotate; the power is transmitted to the output gear 444 through the gearbox 44; and the occlusion teeth 446 on the output gear 444 rotate and drive the pump component 3 to move from top to bottom, so as to realize a liquid sucking action of a pump body.

During the daily use, once the hand is close to the induction lamp component 48, the induction lamp component 48 transmits an induction signal to the control circuit on the mainboard 6, then the control circuit energizes the motor 45, and the motor 45 rotates; the motor 45 rotates from a position A to a position B, and a detailed rotation angle of the motor is measured by the angle counter 46 and then sent to the mainboard 6; when the rotation angle reaches a preset angle value of the mainboard 6, a liquid pumping process is finished, and at the moment the mainboard 6 controls the motor 45 to reversely rotate from the position B to the position A through the control circuit, and the rotation angle thereof is also measured by the angle counter 46 and then sent to the mainboard 6; when the rotation angle reaches the preset angle value of the mainboard 6, the motor stops, and a liquid sucking process of the pump body is finished.

For an adjustment of the liquid discharge amount, it is feasible to change a swinging angle of the occlusion teeth 446 of the output gear 444 through changing the preset angle value of the mainboard 6, thereby realizing the stepless adjustment of the liquid discharge amount.

In conclusion, according to the present invention, the angle counter inducts the rotation angle of the motor; then, according to a rotation condition of the motor, the motor is controlled to reversely rotate and the rotation angle is also controlled, so as to realize the stepless adjustment of the liquid discharge amount and achieve an adjustment function of the liquid discharge amount. When the motor rotates reversely, high lock rotor motor currents at an initial point and an end point are avoided, and a service life of the battery and the parts is increased. The present invention has a simple structure and is easy to be realized.

The above described preferred embodiment is exemplary only and not intended to be limiting. The present invention includes all modifications, equivalent replacement and improvement within the spirit and scope of the present invention.

What is claimed is:

1. A liquid soap dispenser which controls positive and reverse rotations of a motor and a liquid discharge amount through angle counting, comprising: a front cover, a back cover, a liquid soap bottle, a pump component, and a main engine, wherein: the liquid soap dispenser further comprises an angle counter; the liquid soap dispenser is connected with the motor, and the angle counter is driven to rotate through the motor, thereby measuring a chosen angle; the motor is connected with a gearbox, and the gearbox is connected with an output gear; the output gear is fastened at a lower part of the pump component, and the pump component is driven to move through the output gear.

2. The liquid soap dispenser which controls the positive and reverse rotations of the motor and the liquid discharge amount through angle counting, as recited in claim 1, wherein the angle counter and the motor are coaxially arranged.

3. The liquid soap dispenser which controls the positive and reverse rotations of the motor and the liquid discharge amount through angle counting, as recited in claim 1, wherein: the angle counter comprises an angle counting gear, a photosensitive element and a support board; an edge of the angle counting gear has multiple light transmitting slits; the photosensitive element is arranged at a periphery of the angle counting gear and judges an angle chosen by the angle counting gear through sensing lights transmitted through the light transmitting slits; and the support board is for fixing and supporting the angle counting gear and the photosensitive element.

4. The liquid soap dispenser which controls the positive and reverse rotations of the motor and the liquid discharge amount through angle counting, as recited in claim 3, wherein the light transmitting slits are uniformly provided at the edge of the angle counting gear according to a certain angle.

5. The liquid soap dispenser which controls the positive and reverse rotations of the motor and the liquid discharge amount through angle counting, as recited in claim 3, wherein the support board is a printed circuit board (PCB) and electrically connected with the photosensitive element and a control circuit.

6. The liquid soap dispenser which controls the positive and reverse rotations of the motor and the liquid discharge amount through angle counting, as recited in claim 3, wherein the light transmitting slits are triangular, square, trapezoidal, circular or elliptic.

7. The liquid soap dispenser which controls the positive and reverse rotations of the motor and the liquid discharge amount through angle counting, as recited in claim 1, wherein: the output gear has a shaft; a convex reciprocating motion mechanism is fixed on the shaft along a radial direction of the shaft; the reciprocating motion mechanism is fastened at the lower part of the pump component, for controlling a liquid pumping and sucking action of the pump component.

8. The liquid soap dispenser which controls the positive and reverse rotations of the motor and the liquid discharge amount through angle counting, as recited in claim 7, wherein: the reciprocating motion mechanism is two occlusion teeth which extend outward along the radial direction of the shaft of the output gear; an appropriate slot is provided between the occlusion teeth, for allowing the lower part of the pump component to pass through; and, the occlusion teeth are both stuck on a convex part at the lower part of the pump component, so as to drive the pump component to move back and forth.

9. The liquid soap dispenser which controls the positive and reverse rotations of the motor and the liquid discharge amount through angle counting, as recited in claim 1, wherein: the gearbox comprises a power gear and a transmission gear; the power gear is sleeved on a shaft of the motor and meshes with the transmission gear; the transmission gear meshes with the output gear for controlling the pump component; the gearbox further comprises a protection shell for separating the power gear from the motor; and, the power gear and the transmission gear are arranged on the protection shell.

* * * * *